US007798853B2

(12) United States Patent
Shi et al.

(10) Patent No.: US 7,798,853 B2
(45) Date of Patent: Sep. 21, 2010

(54) USB CONNECTOR HAVING NOISE-SUPPRESSING DEVICE

(75) Inventors: Hou-Yu Shi, Kunshan (CN); David Ko, Fullerton, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/432,768

(22) Filed: Apr. 30, 2009

(65) Prior Publication Data

US 2009/0275235 A1 Nov. 5, 2009

(30) Foreign Application Priority Data

Apr. 30, 2008 (CN) ..... 2008 2 0035889

(51) Int. Cl.
*H01R 13/648* (2006.01)

(52) U.S. Cl. ..... 439/607.58; 439/76.1

(58) Field of Classification Search ..... 439/76.1, 439/493, 497, 607.01–607.59, 660, 941
See application file for complete search history.

(56) References Cited

U.S. PATENT DOCUMENTS 5,069,641 A 12/1991 Sakamoto et al.
5,797,771 A * 8/1998 Garside ..... 439/607.46
6,582,252 B1 * 6/2003 Lin ..... 439/607.46
6,685,511 B2 * 2/2004 Akama et al. ..... 439/607.46
6,776,658 B2 8/2004 Tang
6,869,308 B2 * 3/2005 Wu ..... 439/497
6,948,965 B2 * 9/2005 Kumamoto et al. ..... 439/358
7,407,390 B1 * 8/2008 Ni ..... 439/76.1
7,410,366 B2 * 8/2008 Wu ..... 439/76.1
7,575,481 B1 * 8/2009 Liu ..... 439/660

* cited by examiner

*Primary Examiner*—Thanh-Tam T Le
(74) *Attorney, Agent, or Firm*—Andrew C. Cheng; Wei Te Chung; Ming Chieh Chang

(57) ABSTRACT

An electrical connector (1) includes an insulative cover (10), a metal shell (30,40) retained in the insulative cover and a plug portion (80) received in the metal shell. Said plug portion includes a base (60), a plurality of contacts (50) retained in the base and a printed circuit board (70) capable of connecting with the contacts. The base is sunken with a compartment (66). The printed circuit board is retained in the compartment and presses against the contacts.

5 Claims, 7 Drawing Sheets

USB CONNECTOR HAVING NOISE-SUPPRESSING DEVICE

BACKGROUND OF THE INVENTION

1. Field of the Invention

The present invention relates to an electrical connector, more particularly to an Universal Serial Bus (USB) plug connector having noise-suppressing device assembled therein.

2. Description of Related Art

Recently, personal computers (PC) are used of a variety of techniques for providing input and output. Universal Serial Bus (USB) is a serial bus standard to the PC architecture with a focus on computer telephony interface, consumer and productivity applications. USB can connect peripherals such as mouse devices, keyboards, PDAs, gamepads and joysticks, scanners, digital cameras, printers, external storage, networking components, etc. For many devices such as scanners and digital cameras, USB has become the standard connection method. Under the development of technology and the need of market, to reduce the size of USB connector has become an inevitable tendency.

U.S. Pat. No. 5,069,641 issued on Dec. 3, 1991 discloses a modular jack to be mounted on a circuit board, and the modular jack has a printed board containing a noise suppressing electronic element in an insulating housing. The printed board is fitted with contactors for contacting with outer plugs and terminals to be used for mounting the modular jack on the circuit board. The contactors and the terminals are electrically connected with the noise suppressing electronic element by wires on the printed board. But, the printed circuit board is fixed by the contactors and the terminals only and resulting in an unstable situation of the printed circuit board in the insulating housing. Thus, a bad impaction of the electrical connection exists thereon between the printed circuit board and the terminals.

U.S. Pat. No. 6,776,658 issued on Aug. 17, 2004 discloses such a cable end connector with a plug portion. The plug portion comprises a base with a tongue, a plurality of contacts received in the base and a printed circuit board (PCB) soldered with the contacts in back end of the base. Some control IC chips can be installed on the printed circuit board. But, the printed circuit board is fixed only by the solder portion with the contacts, and this may be causing an unstable electrical connecting between the printed circuit board and the contacts. Especially, when insertions and pulls many times, the solder portion of the printed circuit board and the contacts will be loosing, separating the electrical connecting, and more influencing use of the product. Besides, the printed circuit board solders with the contacts in back end of the base, as a result of increasing the whole length of the USB connector.

Hence, there is a need of new design of the electrical connector to eliminate the above mentioned defects of the current electrical connector.

BRIEF SUMMARY OF THE INVENTION

Accordingly, an object of the present invention is to provide an electrical connector with a printed circuit board partially retained in the base.

In order to achieve the above-mentioned object, an electrical connector includes an insulative cover, a metal shell retained in the insulative cover and a plug portion received in the metal shell. Said plug portion includes a base, a plurality of contacts retained in the base and a printed circuit board capable of connecting with the contacts. The base defines a compartment. The printed circuit board is retained in the compartment to connect with the contacts and having a portion to mount cable.

The foregoing has outlined rather broadly the features and technical advantages of the present invention in order that the detailed description of the invention that follows may be better understood. Additional features and advantages of the invention will be described hereinafter which form the subject of the claims of the invention.

DETAILED DESCRIPTION OF THE PREFERRED EMBODIMENTS

Figure 1:
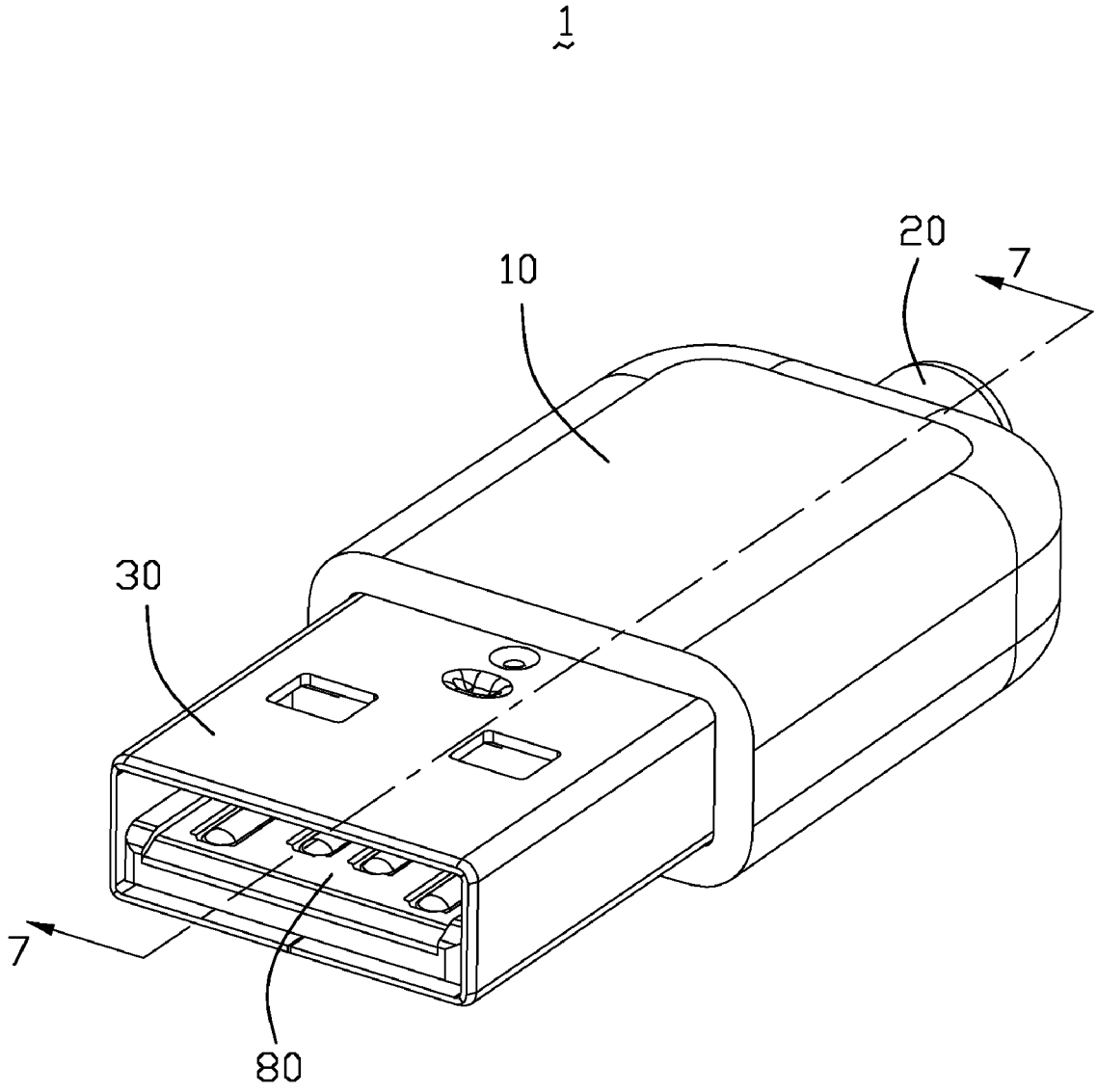
FIG. 1 is a perspective view of an electrical connector of the present invention.
Figure 2:
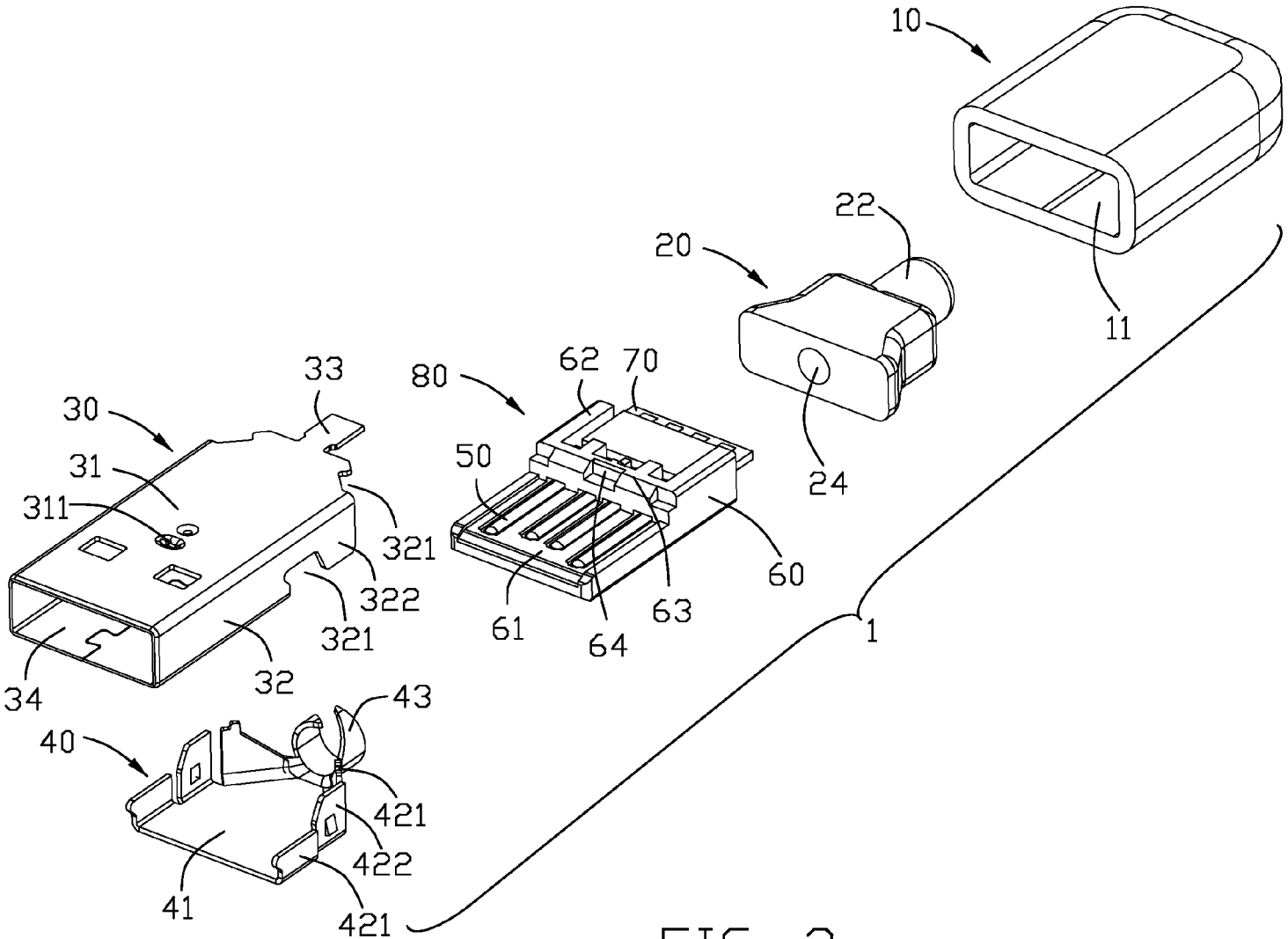
FIG. 2 is an exploded, perspective view of the electrical connector as shown in FIG. 1.
Figure 3:
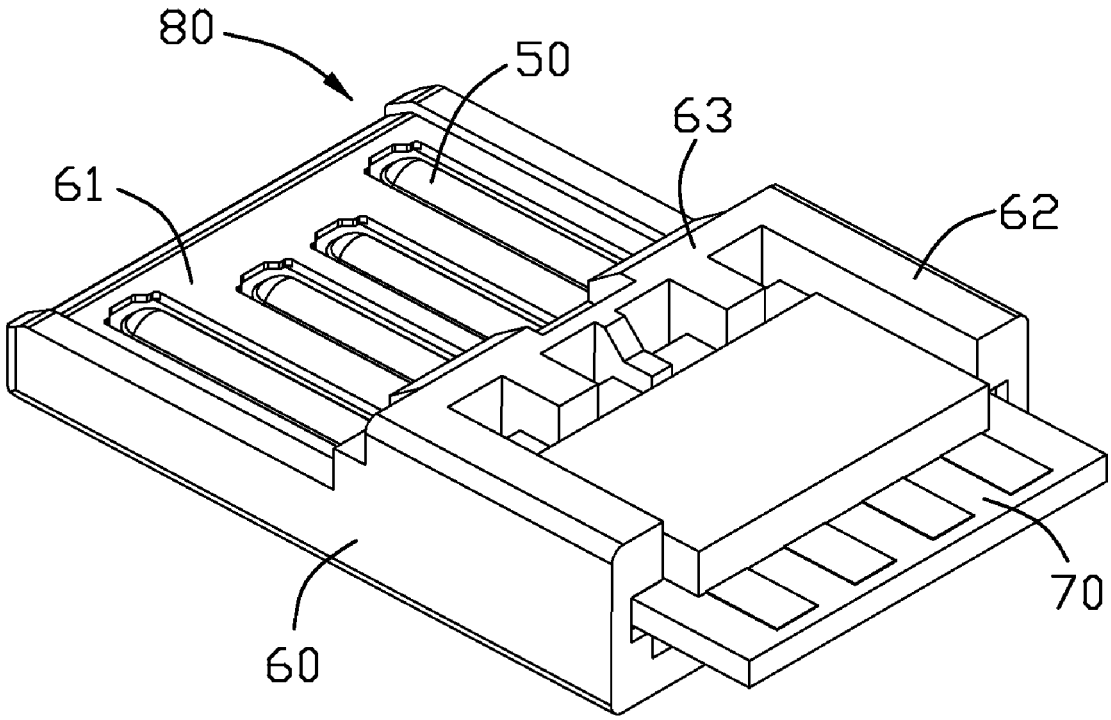
FIG. 3 is a perspective view of the plug portion of the electrical connector of the present invention.
Figure 4:
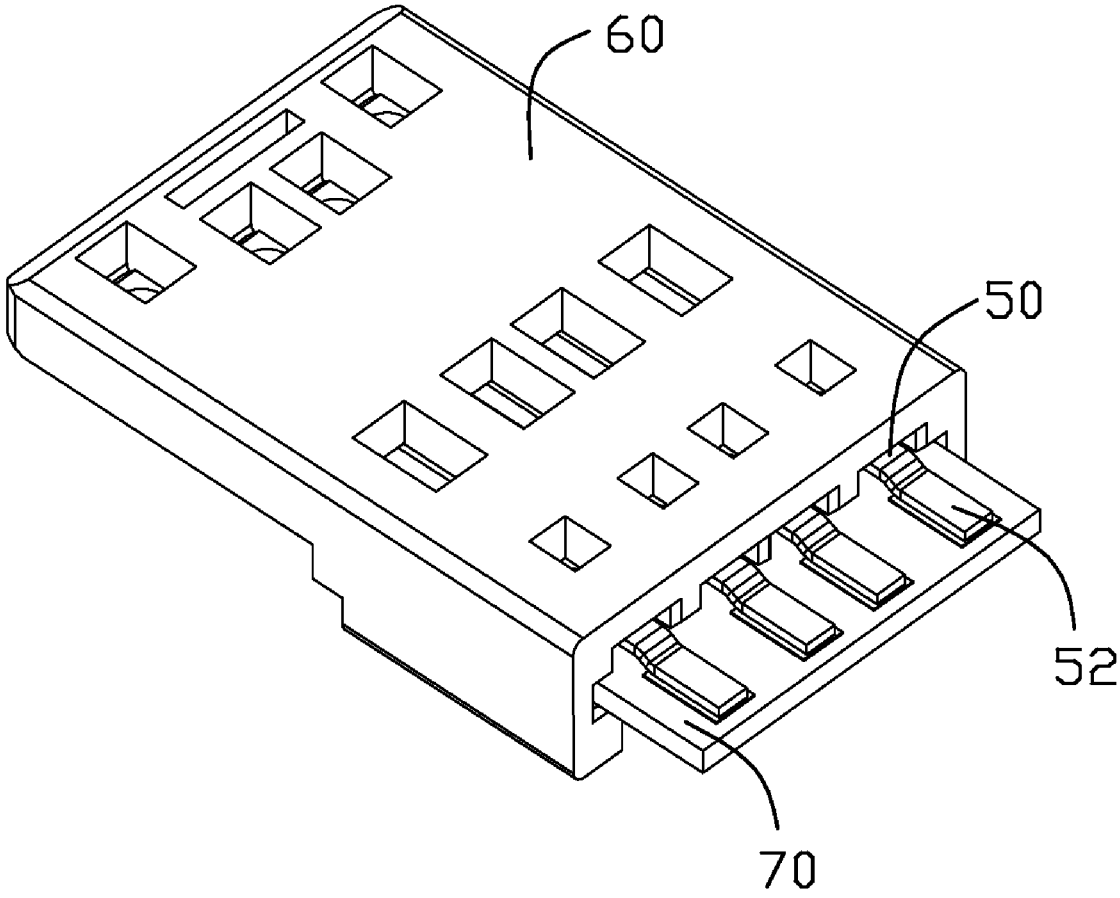
FIG. 4 is a view similar to FIG. 3, but viewed from a different aspect.
Figure 5:
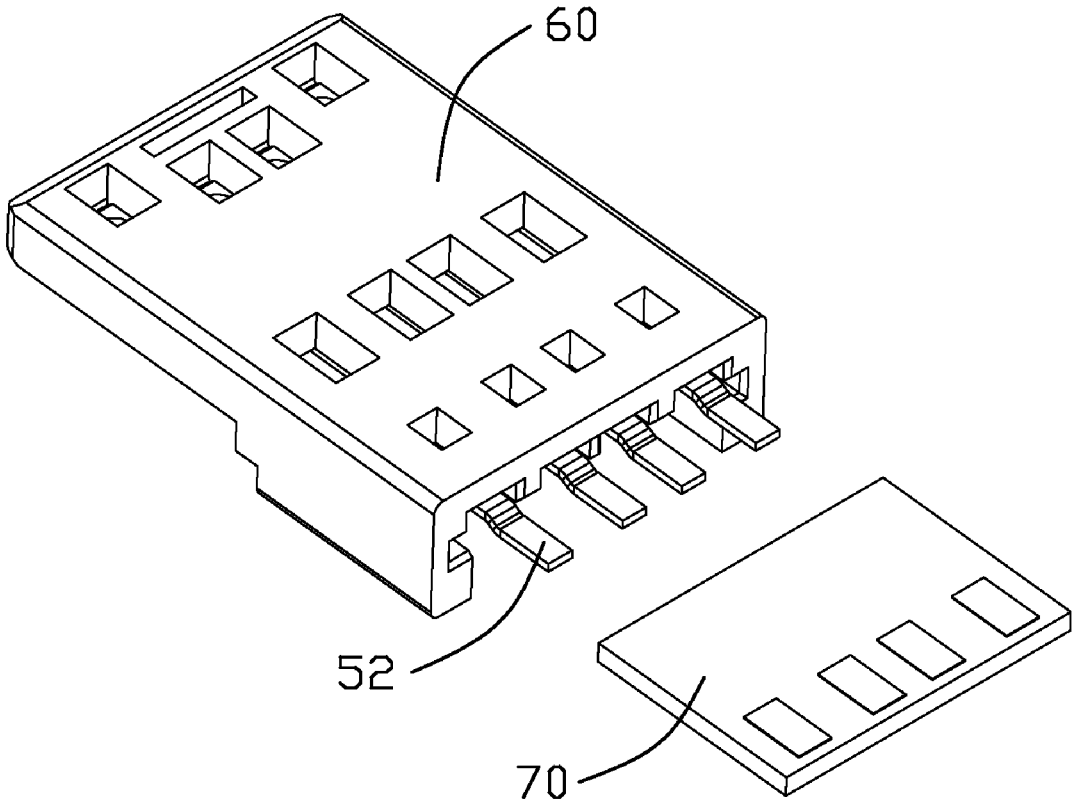
FIG. 5 is an exploded, perspective view of the printed circuit board is separated from plug portion as shown in FIG. 4.
Figure 6:
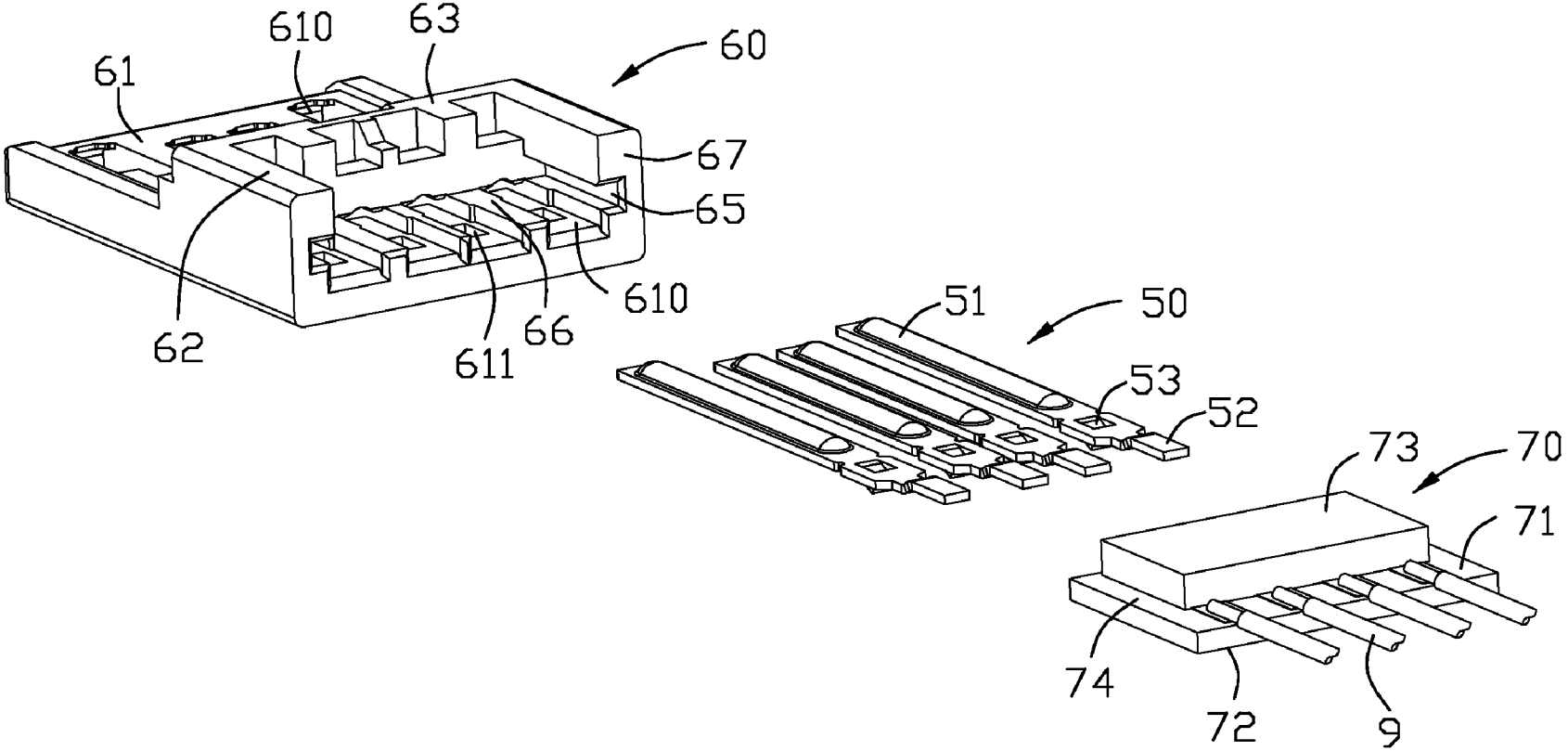
FIG. 6 is an exploded, perspective view of the electrical connector as shown in FIG. 3.
Figure 7:
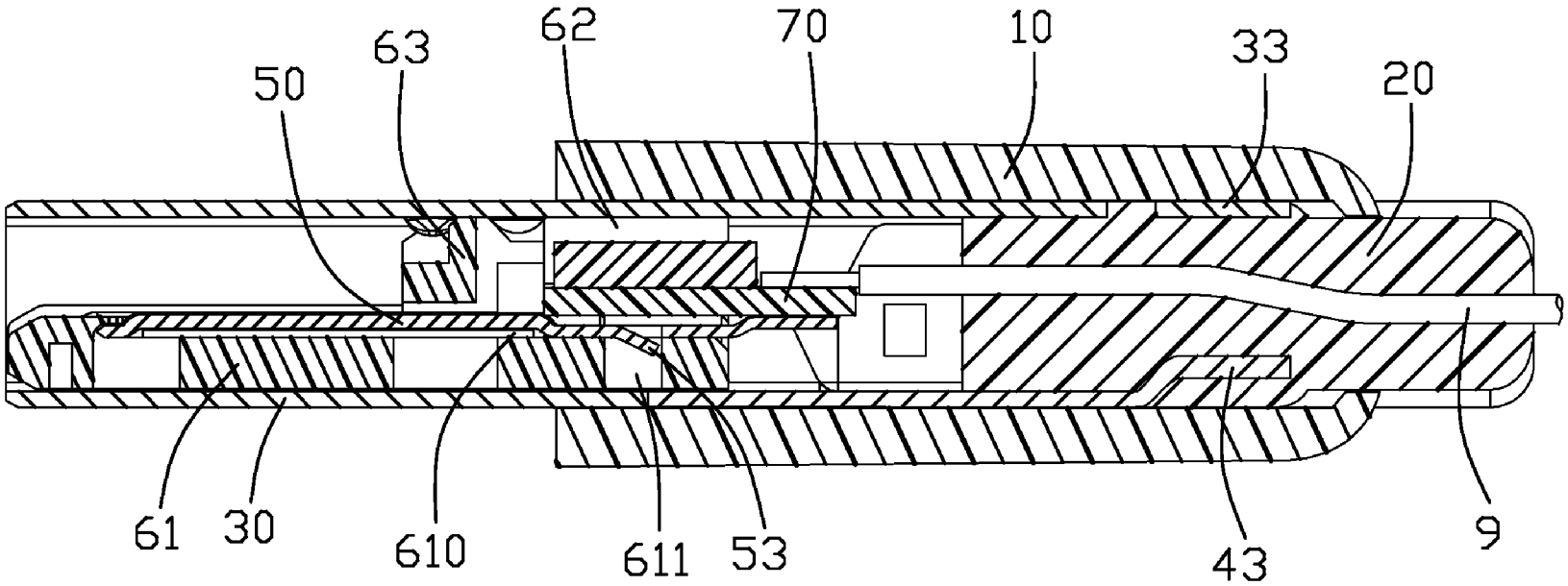
FIG. 7 is a cross-section view taken along line 7-7 of FIG. 1.

Reference will now be made to the drawing figures to describe the present invention in detail. Referring to FIGS. 1-2, an electrical connector 1, that is an USB connector. The electrical connector 1 comprises an insulative cover 10, two metal shells 30 and 40 partially received in the insulative cover 10, a plug portion 80 installed in the metal shell 30 and a plastic portion 20 injection molded in the back end of the connector 1 by insulative materials. Said insulative cover 10 defines a receiving hole 11 used for receiving the metal shells 30 and 40. A cable mounting hole (not labeled) connecting with the cable mounting hole 11 is defined end of the insulative cover 10 and receiving a cable 9 (as shown in FIG. 7).

Referring to FIGS. 3-7, said plug portion 80 includes an insulative base 60 having a mounting portion 62 and an insulative tongue 61 extending from the insulative base 60 in a back-front direction, a set of contacts 50 received in the insulative base 60, a printed circuit board 70 soldered with the contacts 50, and partially retained in the mounting portion 62 in a back-front direction. A step portion 63 connects the tongue 61 with the mounting portion 62 of the base 60. The mounting portion 62 is partly sunk with a bottom plate (not labeled) and two opposite side walls 67 extending upwardly from two sides of the bottom plate to define a compartment 66, the inner surfaces of the two opposite side walls 67 has two channels 65. several passageways 610 extends from the bottom surface of the compartment 66, and penetrating the step portion 63 until arriving of the tongue 61. Viewed from the up aspect, the passageways 610 are obviously which the parts locates on the compartment 66 and the tongue 61. Some fixing holes 611 are formed in the passageways 610. The centre of the step portion 63 of the base 60 (as shown of the FIG. 2) has a scoop channel 64.

Each contact 50 includes a contact portion 51 bulging upwardly, a fixing portion (not labelled) extending backwardly from the contact portion 51, and the fixing portion partially hollowing downwardly formed a locking bard 53. A rear portion 52 extends with a incline-up direction from the fixing portion. In assemble processes, the contacts 50 are retained in the passageways 610 from the mounting portion 62 in a back-front direction. And this time, the locking bards 53 of the contacts 50 are retained in the fixing hole 611 of the base 60 and buckling each other. When the contacts 50 received in the passageways 610, the level position of the rear portion 52 is higher than the bottom level of the channel 65 of the side wall 67. The rear portion 52 projects outwardly and separating from the mounting portion 62 of the base 60.

The printed circuit board 70 is generally rectangular, including an upper face 71, an opposite bottom face 72 and two side portions 74. Several control IC chips or noise-suppressing device 73 (such as control IC chip or other electrical components) solders on the upper face 71 of the printed circuit board 70 to control the connector 1 working with the connecting electrical device (not shown). The printed circuit board 70 is partially received in the compartment 66 of the base 60 by moving the side portions 74 of the printed circuit board 70 to slide along the channels 65 of the base 60. Two faces of the printed circuit board 70 separately have soldering portion (not labeled). The soldering portion of the upper face 71 connects with an outer cable 9 and the bottom face 72 soldering with the rear portion 52 of the contacts 50. The printed circuit board 70 is inserting into the compartment 66 by sliding along the channels 65, because of the level position of the rear portion 52 of the contacts 50 being higher than the bottom level of the channels 65, The printed circuit board 70 will additionally pressing against the contacts 50 tightly. Thus ensures the contacts 50 in a stable condition to perform a good electrical connection. Besides, the space take up by the printed circuit board 70 is reduced greatly. Thus, the whole length of the USB connector 1 is shorter.

Referring to FIG. 2, said metal shell 30 includes upper and down main bodies 31, two side walls 32 for connecting the two main bodies 31, from thus defined a cavity 34 for receiving the plug portion 80. an indentation 321 and an extending plate 322 are defined in the Rear back end of the upper main body 31. A prominence 311 hollows from the upper main body 31 for locking with the scoop channel 64 of the base 60. An intersection 33 extends backwardly from the rear end of the upper main body 31. The other metal shell 40 has a platform 41, several plates 421 bending and extending upwardly from the platform 41 to equip with the corresponding indentation 321 and extending plate 322. A cable fixing device 43 is defined in the rear end of the metal shell 40 corresponding to the intersection 33 of the metal shell 30 for fixing the outer cable 9.

Referring to FIGS. 1-7, in installment of processes, the first step, installed the plug portion 80. The contacts 50 are installed into the passageway 610 of the base 60, and then, pushing the printed circuit board 70 into the mounting portion 62 of the base 60 and soldering with the rear portion 52 of the contacts 50. The printed circuit board 70 presses downwardly against to the contacts 50 to fix the contacts 50. The second step, an outer cable (not shown) is provided to connect with the soldering balls of the printed circuit board 70. Used of the finished plug portion 80 to push into the cavity 34 of the metal shell 30 in a back-front direction, the other metal shell 40 installed on the metal shell 30 in a down-up direction, the fixing device 43 equipping with the intersection 33 to fix the outer cable. The cable passes through the cable mounting hole of the insulative cover 10. The metal shells 30 and 40 which includes the plug portion 80 pushes into the receiving hole 11 of the insulative cover 10. The third step, the finished connector 1 have unnecessary space in rear of the metal shells 30, 40 and the insulative cover 10. In this step, an Auxiliary device is provided to inject some insulative materials into the unnecessary space of the connector 1 from the cable mounting hole of the insulative cover 10. From thus, formed an Anomalous shape injection molding department 20 to prevent the plug portion 80 from moving backwardly. The FIGS shown shape isn't necessary of the true object. The injection molding department 20 defines a cable hole 24 to receive outer cable, a hat section 22 of the injection molding department 20 revealed in end of the insulative cover 10.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector comprising:

an insulative base having a mating tongue, a compartment extending from the mating tongue, and a plurality of passageways extending from the compartment to a mating surface of the mating tongue;

a plurality of contacts assembled to the passageways, and each contact including a contact portion exposed on the mating surface of the mating tongue, and a rear portion facing toward the compartment; and a printed circuit board with at least one noise-suppressing device, disposed within the compartment and electrically interconnected with the rear portions of the contacts; wherein the base has a mounting portion with a bottom plate and two side walls extending upwardly from two sides of the bottom plate to define the compartment; wherein several channels are formed in interior face faces of the side walls and the printed circuit board slides into the compartment under guidance of the channels; wherein the rear portion of the contacts which the level position is higher than the bottom level of the channel under the contacts received in the passageways; wherein the printed circuit board presses against the rear portions of the contacts to fix the contacts in the base; wherein each passageway extends from the bottom surface of the compartment through the mounting portion to the tongue and rear portion of the contacts are exposed to the compartment; wherein each of said contacts defines a locking device for retaining the contact to the housing and said locking device is located behind a front edge of the printed circuit board in a front-to-back direction; wherein the electrical connector further comprises an insulative cover and a metal shell, said base enclosed by the metal shell and the insuative cover partly receiving the metal shell; and wherein the base further comprises a step portion connecting the tongue with the mounting portion and a scoop channel defined in the step portion, said metal shell locks with the scoop channel.

2. The electrical connector as claimed in claim 1, wherein the printed circuit board has two faces and two side portions sliding along the channels.

3. The electrical connector as claimed in claim 2, wherein two faces of the printed circuit board define several soldering portions to solder contacts and outer cable respectively.

4. The electrical connector as claimed in claim 3, wherein the noise-suppressing device is disposed on one face of the printed circuit board opposite to the other face which the rear portions of the contacts are adhered to.

5. An electrical connector comprising:

an insulative housing defining a mating port having a mating face thereon;

a plurality of passageways formed in the housing;

a plurality of contacts disposed in the corresponding passageways, respectively, each of said contacts defining a mating section exposed upon the mating face and facing toward the mating port in a vertical direction, and a tail section opposite to the mating section in a front-to-back direction perpendicular to said vertical direction;

a printed circuit board located in a rear portion of the housing behind the mating port, said printed circuit board defining opposite first and second surfaces; and a plurality of cables located behind the printed circuit board, each of said cables defining an inner conductor; wherein the tail sections of the contacts are mechanically and electrically connected to the first surface of the printed circuit board, and a noise suppression device and said inner conductors of the cables are commonly mechanically and electrically connected to the second surface of the printed circuit board; wherein said second surface is located opposite to said first surface in said vertical direction; wherein said noise suppression device is located in front of the inner conductors, the tail sections of the contacts are soldered to a rear region of the first surface, and the inner conductors of the cables are soldered upon a rear region of the second surface essentially aligned with the rear region of the first surface in said vertical direction; wherein said printed circuit board is essentially separated from the mating port in the front-to-back direction by the housing, each of said contacts defines a locking device for retaining the contact to the housing, and said locking device is located behind a front edge of the printed circuit board in said front-to-back direction; wherein the electrical connector further comprises an insulative cover and a metal shell, said housing enclosed by the metal shell and the insuative cover partly receiving the metal shell; and wherein the housing further comprises a step portion connecting the mating port with a mounting portion and a scoop channel defined in the step portion, said metal shell locks with the scoop channel.

* * * * *